US005768930A

United States Patent [19]

Eckehard

[11] Patent Number: 5,768,930

[45] Date of Patent: Jun. 23, 1998

[54] WIRE STRAIGHTENING DEVICE

[75] Inventor: Albert Eckehard, Berlin, Germany

[73] Assignee: Witels Apparate-Maschinen Albert GmbH & Co KG, Berlin, Germany

[21] Appl. No.: 797,570

[22] Filed: Feb. 7, 1997

[30] Foreign Application Priority Data

Feb. 23, 1996 [DE] Germany ..... 196 06 875.4

[51] Int. Cl.[6] ..... B21D 1/02

[52] U.S. Cl. ..... 72/164

[58] Field of Search ..... 72/164, 160, 162

[56] References Cited

U.S. PATENT DOCUMENTS

| | | | |
|---|---|---|---|
| 1,914,975 | 6/1933 | Nigro | 72/164 |
| 2,343,899 | 3/1944 | Groll | 72/160 |
| 4,663,955 | 5/1987 | Redman | 72/160 |
| 4,949,567 | 8/1990 | Corbin | 72/164 |
| 5,467,629 | 11/1995 | Albert | 72/164 |

FOREIGN PATENT DOCUMENTS

| | | | |
|---|---|---|---|
| 2 306 585 | 8/1974 | Germany . | |
| 3 637 468 | 9/1987 | Germany . | |
| 3 226 665 | 8/1990 | Germany . | |
| 4 311 300 | 2/1994 | Germany . | |
| 138821 | 5/1992 | Japan | 72/160 |
| 567526 | 8/1977 | U.S.S.R. | 72/160 |
| 507029 | 6/1945 | United Kingdom | 72/164 |

*Primary Examiner*—Daniel C. Crane
*Attorney, Agent, or Firm*—Collard & Roe, P.C.

[57] ABSTRACT

A straightening device for wire, multiple-wire or tubular material with straightening rollers in two planes that are essentially parallel to the running direction of the material. The rollers are arranged vertical to the material and the rollers are parallel to, but offset from each other. These straightening rollers are adapted to be adjusted singly or severally together toward and away from the material. At least one of the rollers is a height-adjustable straightening roller.

11 Claims, 2 Drawing Sheets

WIRE STRAIGHTENING DEVICE

BACKGROUND OF THE INVENTION

1. Field of the Invention

The present invention relates to a straightening device for wire, multiple wire, or tubular material.

2. The Prior Art

Known straightening devices of this type are used to eliminate the initial bend radii of reel and coil turns and are known, for example, from German Patent Application No. DE-C2-3226665 and from German Patent Application No. DE C1-4311300.

German Patent Application No. DE-OS 2 306 585 discloses a method for straightening wire by twisting to produce straight rods displaying no torsion. This action occurs when the wire is cut, clamped and twisted about its axis just long enough in one direction and long enough in the opposite direction as the material needs to ultimately produce a straight and, to outward appearances, untwisted wire.

German Patent Application No. DE 36 37 468 discloses a method and device for straightening wire, whereby the wire is unwound from an unwinding means. The wire next feeds into a means for twisting and stretching the wire with straightening elements. The wire is next subjected to simultaneous twisting in two opposite directions. The twisting continues up to the onset of the wire material's plastic deformation range, after which it is wound into a means for winding up the wire.

As a rule, the wire material also displays three-dimensional twists, torsions or helices, which cannot be eliminated by the known straightening method.

SUMMARY OF THE INVENTION

It is therefore an object of the present invention to overcome the drawbacks of the prior art and to create a straightening device which removes twists, torsions, or helices in three-dimensional direction from the initial material.

It is another object of the invention to introduce twists, torsions or helices, in the initial material in defined measure, should this be required for the follow-up production process.

The present invention comprises a straightening device for wire, multiple-wire or tubular material having straightening rollers arranged in two planes that are essentially parallel to the running direction of the material. The rollers are arranged vertical to the material and parallel to, but offset from each other. These straightening rollers are adapted to be adjusted singly or together, both toward and away from the material. At least one of the rollers is a height-adjustable straightening roller.

Because of the invention, it is now possible to completely eliminate, i.e., neutralize twists, torsions or helices (hereafter referred to only as helices) or also to induce any desired helices in the material by applying a torque on the material. The torque is produced by a straightening device with at least one height-adjustable straightening roller.

Opposing straightening roller grooves are created between the rollers, which do not lie in the same plane because of the relative adjustment of their height. These straightening roller grooves produce a forced bending moment parallel to the axis of rotation of the straightening rollers. This forced bending moment is a result of the unequal, offset side pressure against the material of the respective contact faces. Adjusting the height of the straightening rollers enables the groove angle, which normally equals only 90°, to be opened to at least 120°, whereby the material is more inclined to turn rather than jam during superimposition of torque.

With the superimposition of a stress prior to the straightening, it is possible to produce a constant bend radius in an initial material having changing and/or large initial bend radii. This constant bend radius eliminates the need to make continuous checks and adjustments to the device where necessary.

To achieve this stress on the wire, the wire is subjected to a dead straightener. Using a dead straightener prior to the wire straightening eliminates the need to make continuous adjustments to the first bending rollers of the known straightener. This result is imperative on a conventional straightening device because of the changing and/or large initial bend radii in the material. With the dead straightener, the material is brought into a rotationless gripped position in a tight and extreme wrap around two straightening rollers and is then guided around a straightening roller of a smaller diameter, whereby it adopts a constant bend radius for the follow-up straightening process. This bend radius determines the initial setting of the follow-up straightening device.

One major advantage of this invention is that there is no need for any re-adjustments of the straighteners because the constant bend radius no longer changes.

BRIEF DESCRIPTION OF THE DRAWINGS

Other objects and features of the present invention will become apparent from the following detailed description considered in connection with the accompanying drawings, which disclose two embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
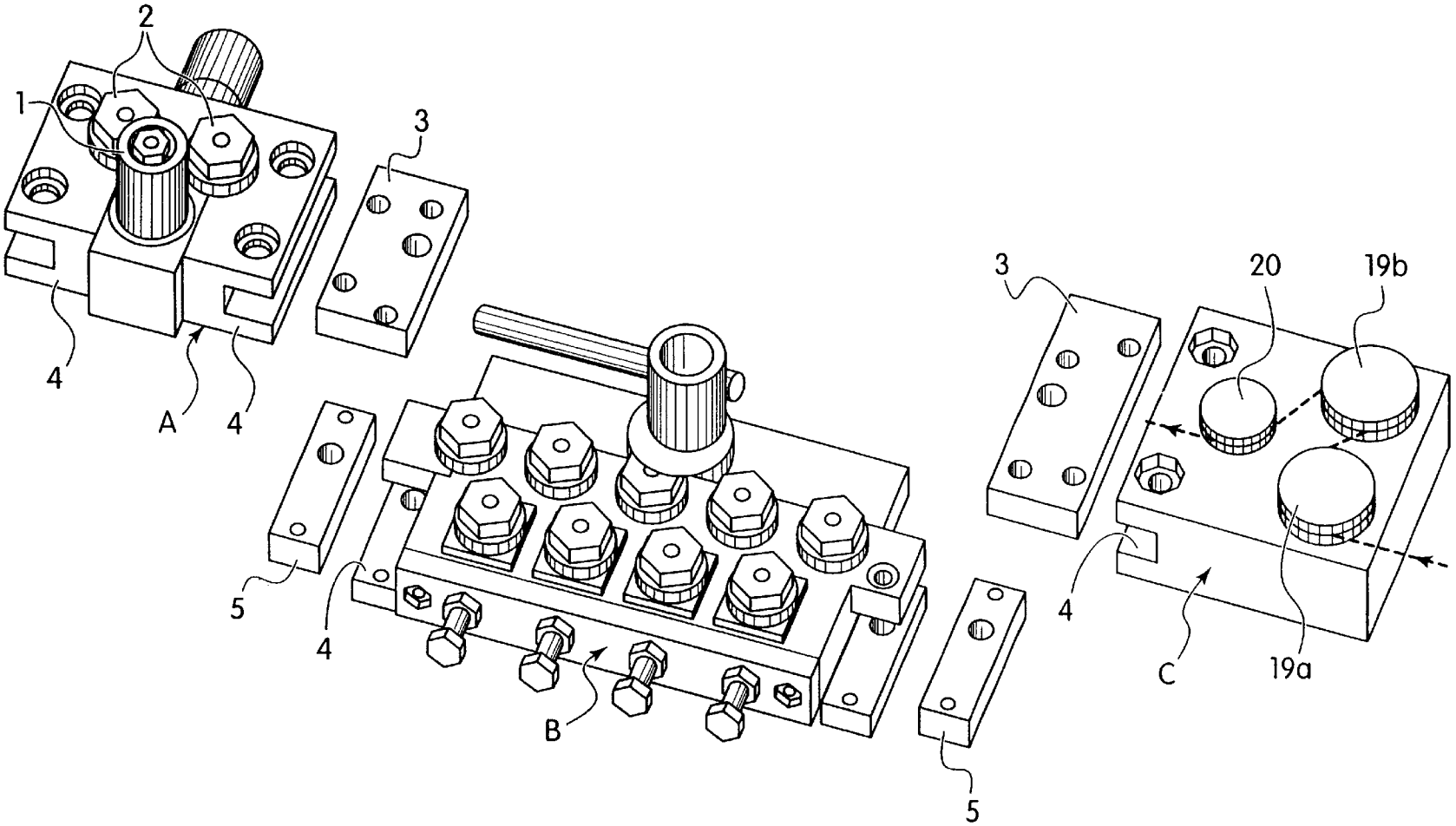
FIG. 1 is a perspective view of a straightening device consisting of three units, A, B, and C which are adapted to be joined together by connecting elements.

Referring now in detail to the drawings and, in particular, FIG. 1, a three part straightening device is disclosed which has units A, B, and C. Unit A contains a height adjustable straightening roller 1, and two non-height adjustable straightening rollers 2. Unit B represents a conventional straightening device as shown in German Patents DE-C2-3226665 and DE-C12-4311300. Therefore, this unit is not described in further detail because any known straightening device can be used for intermediate unit B. A third unit is straightening device C, which acts as a dead straightener. The individual units A, B, and C can be joined securely and in central position to each other by means of connecting elements 3. Units A and B each have recesses 4 at both ends and the unit C has a recess 4 at one end. When unit B connects at one end with unit A or C, an end element 5 allows for mounting in the respective recess 4 at the respective free end. Connecting elements 3 are all designed as adapters to fit half-way in recess 4 of the one unit and half-way in the other unit of any two units to be joined together. End elements 5 are halved accordingly.

On unit A, height adjustable straightening roller 1 is also adjustable in relation to the running direction of the material. Adjusting devices for straightening rollers toward and away from the material are known from the above mentioned publications. Non-height-adjustable straightening rollers 2 can be constructed to be either stationary or adjustable in relation to the running direction of the material.

Figure 2:
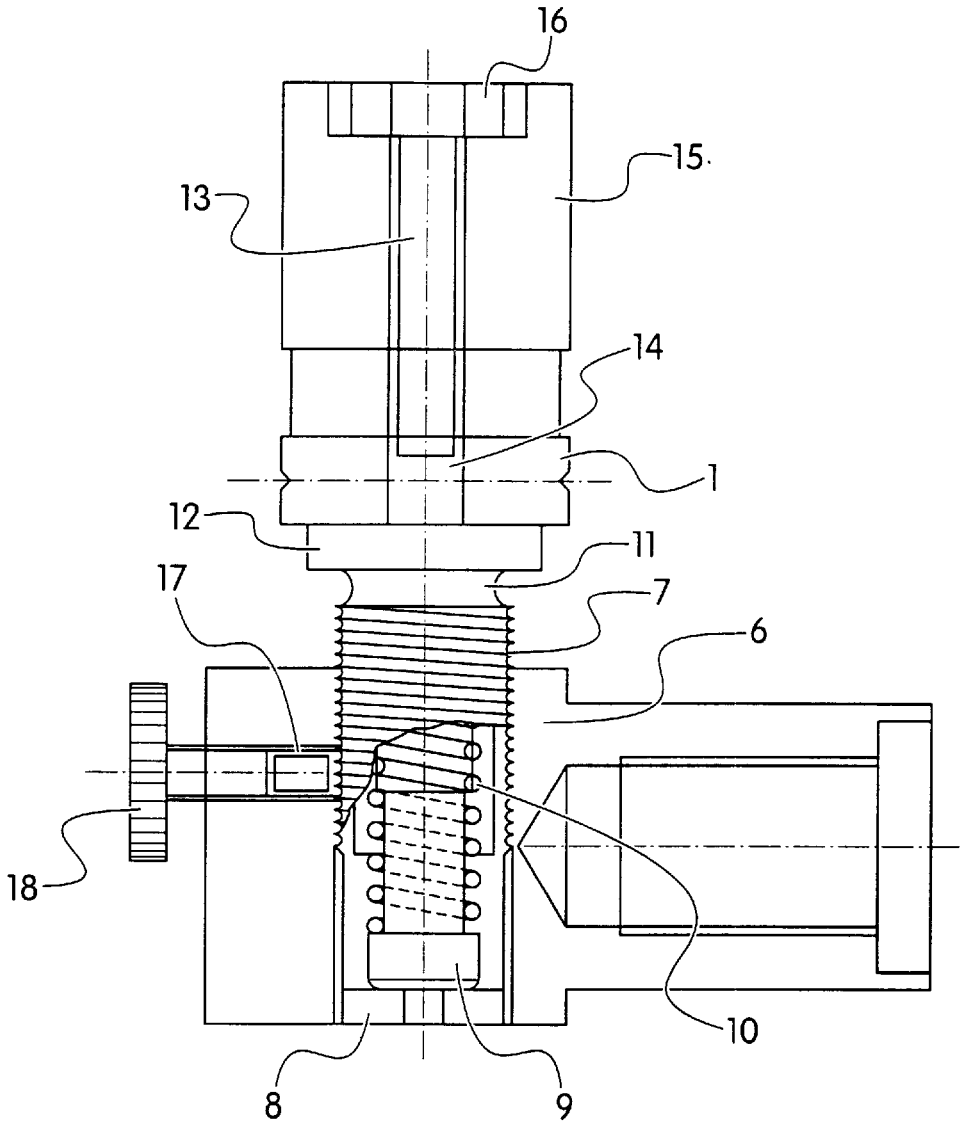
FIG. 2 is an embodiment of a height adjustable straightening roller.
Figure 3:
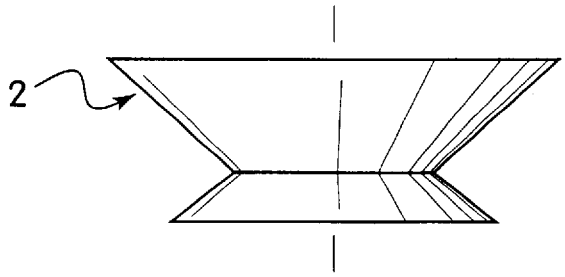
FIG. 3 shows an example of a straightening roller having an unequal sided groove angle.

FIG. 2 discloses an embodiment of the height adjustment arrangement of a height-adjustable roller. In the embodiment shown in FIG. 1, there is only one height-adjustable straightening roller 1 in the one plane, which is faced in the second plane by two non-height-adjustable straightening rollers 2 in a position centrally offset to the height-adjustable roller.

FIG. 2 shows an adjustable base element 6, for moving straightening roller 1 toward and away from the running direction of the material. Base element 6 has a vertical threaded hole 7 to which a pressure plate 8 is fastened or screwed in as a bed. Pressure plate 8 has a centering pin 9 arranged axially in threaded hole 7. Centering pin 9 can be connected to pressure plate 8 in a releasable or non-releasable manner and serves for guiding a pressure spring 10.

A threaded spindle 11 is screwed into threaded hole 7. Spindle 11 has a head 12 and an upward pointing threaded axle 13, which has a male thread and is fastened to the head 12. Machined sea t 14 is screwed on threaded axle 13 in the area of the head 12. Straightened roller 1 is mounted on machined seat 14 so that it can turn freely. Knurled nut 15 is placed over the threaded axle 13 and is fastened by nut 16 to threaded axle 13. Knurled nut 15 rests on top of head 12 of threaded spindle 11 so that it cannot turn when fastened by nut 16. Rotatable straightening roller 1 can be mounted on head 12 by means of ball bearings, roller bearings or other bearings, with knurled nut 15 as well as on the machined seat 14.

In base element 6, there is also a further hole 17 leading into the threaded hole 7. Hole 17 accommodates a releasable locking device 18, which may be of any locking device, such as a clamping screw with a soft clamping sleeve. This locking device is used to secure the threaded spindle 11 in the set vertical position required.

When locking device 18 is unlocked, the height of roller 1 can be adjusted by turning knurled nut 15 in one or the other direction whereby threaded spindle 11 moves up or down the threaded hole 7. One end of pressure spring 10 rests inside threaded spindle 11 on its head 12. This pressure spring neutralizes the thread backlash and enables precise fine adjustment with slight pre-clamping.

In FIG. 1, unit C serves as a dead straightener and has two straightening rollers 19*a* and 19*b* of larger diameter at the material infeed end, and one straightening roller 20 of smaller diameter at the outfeed end. First straightening roller 19*a* at the material infeed end and straightening roller 20 at the outfeed end are arranged so that second straightening roller 19*b* is enwrapped by the material at an angle of at least 180° but preferably greater than 210°. To insure a range of variation for a wrap angle, it is possible to adapt infeed straightening roller 19*a* and/or outfeed straightening roller 20 in unit C to be adjustable. Adjustability of straightening roller 19*a* alone or along with other rollers is also possible.

The diameter of the larger straightening rollers 19*a*, 19*b* relative to the diameter of the smaller straightening roller 20 is a ratio between 1:0.6 and 1:0.8. Translated into millimeter size, the ratio varies from 31 mm:23 mm; 23 mm:17 mm; or 13 mm:9 mm.

As stated earlier, the straightening device can consist of up to three different units: A, B, or C. Relative to the material running direction, the straightening device can consist of units C, B, A in that order, or C, A, B or C, A, B, A or B, A or A, B or A, B, A depending on the required purpose and on the magnitude of twists, torsions or helices to be eliminated or induced and depending on the desired or required quality of the material.

Therefore, the straightening devices can be assembled at random from individual independent units A, B, and C which can be joined together by connecting elements 3 and element 5.

In a different embodiment of the invention, the desired combination can be joined together as a non-releasable straightening unit that cannot be taken apart.

In another embodiment of the invention, unit B can also have one or several height-adjustable straightening rollers. The height adjustable straightening rollers can also be arranged at random or singly or severally or all together in one or two planes.

While several embodiments of the present invention have been shown and described, it is to be understood that many changes and modifications may be made thereunto without departing from the spirit and scope of the invention as defined in the appended claims.

What is claimed is:

1. A straightening device for the treatment of material such as wire, multiple wire or tubular material running in a predetermined direction, comprising:

a first unit and a second unit, each unit comprising a plurality of straightening rollers having vertical axes arranged in two planes substantially parallel to the running direction of the material, said material running between said planes, said straightening rollers adapted to be adjusted either singly or together, toward and away from the material, wherein said straightening rollers are off-set from each other, and wherein said first unit has at least one straightening roller that is adjustable in height along its vertical axis and said second unit has non-height adjustable straightening rollers; and a third unit comprising a dead straightener connected to one of the first and second units at the infeed end relative to the running direction of the material, said dead straightener comprising first and second straightening rollers of larger diameter at the material infeed end, and a third straightening roller of smaller diameter at the outfeed end.

2. A straightening device according to claim 1, wherein the height adjustable straightening roller in one plane is off-set between two neighboring straightening rollers in another plane.

3. A straightening device according to claim 1, wherein the first unit has two height adjustable straightening rollers in one plane, between which a straightening roller is off-set in another plane.

4. A straightening device according to claim 1, wherein all of the straightening rollers in one plane of the first unit are adjustable in height.

5. A straightening device according to claim 1, wherein the straightening rollers are positioned so that they define a groove angle of greater than 90°.

6. A straightening device according to claim 1, wherein the first and second units are joined together by releasable connections.

7. A straightening device according to claim 1, wherein at least the second straightening roller is enwrapped by the material with a wrap angle of greater than 180°.

8. A straightening device according to claim 7, wherein the wrap angle is greater than 210°.

9. A straightening device according to claim 1, wherein the ratio of the larger diameter of the straightening rollers to the smaller diameter of the straightening roller is between 1:0.08 to 1:0.06.

10. A straightening device according to claim 1, wherein the third unit forms an independent module which is releasably joined to one of the units.

11. A straightening device according to claim 1, wherein the straightening rollers have a groove angle that is not equal sided.

* * * * *

UNITED STATES PATENT AND TRADEMARK OFFICE

CERTIFICATE OF CORRECTION

PATENT NO. : 5,768,930

DATED : June 23, 1998

INVENTOR(S) : Eckehard ALBERT

It is certified that error appears in the above-indentified patent and that said Letters Patent is hereby corrected as shown below:

On the title page, item [19] change "Eckehard" to read --Albert-- and;

in item [75], change "Albert Eckehard" to --Eckehard Albert--.

Signed and Sealed this

Twenty-second Day of September, 1998

*Attest:*

Bruce Lehman

BRUCE LEHMAN

*Attesting Officer*

*Commissioner of Patents and Trademarks*